US008062070B2

(12) United States Patent
Jeon et al.

(10) Patent No.: US 8,062,070 B2
(45) Date of Patent: Nov. 22, 2011

(54) CONNECTOR ASSEMBLY HAVING A COMPENSATION CIRCUIT COMPONENT

(75) Inventors: Myoungsoo Jeon, Harrisburg, PA (US); Attalee Snarr Taylor, Palmyra, PA (US); John Joseph Consoli, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/724,217

(22) Filed: Mar. 15, 2010

(65) Prior Publication Data

US 2011/0223807 A1 Sep. 15, 2011

(51) Int. Cl.
*H01R 13/66* (2006.01)

(52) U.S. Cl. ..... 439/620.22

(58) Field of Classification Search ..... 439/620.01, 439/620.22, 620.12, 620.15
See application file for complete search history.

(56) References Cited

U.S. PATENT DOCUMENTS

| | | | | |
|---|---|---|---|---|
| 5,153,540 | A | 10/1992 | Gliha, Jr. | |
| 6,709,294 | B1 * | 3/2004 | Cohen et al. | 439/620.01 |
| 6,808,399 | B2 * | 10/2004 | Rothermel et al. | 439/607.05 |
| 6,843,687 | B2 * | 1/2005 | McGowan et al. | 439/607.06 |
| 6,932,649 | B1 | 8/2005 | Rothermel et al. | |
| 6,979,226 | B2 | 12/2005 | Otsu et al. | |
| 7,285,018 | B2 * | 10/2007 | Kenny et al. | 439/620.01 |
| 7,540,781 | B2 | 6/2009 | Kenny et al. | |
| 2002/0098738 | A1 * | 7/2002 | Astbury et al. | 439/608 |
| 2005/0032430 | A1 * | 2/2005 | Otsu et al. | 439/608 |
| 2005/0287869 | A1 * | 12/2005 | Kenny et al. | 439/620 |
| 2009/0311908 | A1 * | 12/2009 | Fogg et al. | 439/607.05 |

* cited by examiner

*Primary Examiner* — Briggitte R Hammond

(57) ABSTRACT

A connector assembly includes a contact module with a lead frame having signal conductors defining separate conductive paths. The contact module also includes a compensation circuit component coupled to the leadframe. The compensation circuit component has a substrate and multiple compensation circuit elements mounted to the substrate, where the substrate is coupled to the leadframe such that the compensation circuit elements are electrically connected to corresponding signal conductors. The contact module also includes a body encasing the signal conductors and the compensation circuit component.

20 Claims, 7 Drawing Sheets

CONNECTOR ASSEMBLY HAVING A COMPENSATION CIRCUIT COMPONENT

BACKGROUND OF THE INVENTION

The subject matter herein relates generally to connector assemblies, and more particularly, to connector assemblies having electrical compensation components.

With the ongoing trend toward smaller, faster, and higher performance electrical components such as processors used in computers, routers, switches, etc., it has become increasingly desirable for the electrical interfaces along the electrical paths to also operate at higher frequencies and at higher densities with increased throughput. For example, performance demands for video, voice and data drive input and output speeds of connectors within such systems to increasingly faster levels.

Electrical connectors typically are arranged to be connected to complementary connector halves to form connector pairs. One application environment that uses such electrical connectors is in high speed, differential electrical connectors, such as those common in the telecommunications or computing environments. In a traditional approach, two circuit boards are interconnected with one another in a backplane and a daughter board configuration. However, similar types of connectors are also being used in cable connector to board connector applications. However, such electrical connectors are not without problems. For instance, as the throughput speed of such electrical connectors increases, the electrical connectors are more susceptible to performance degradation. Compensation for signal degradation is provided on the backplane or daughtercard boards being connected. Such solutions have heretofore proven difficult. For example, the compensation may be provided relatively far from the source of degradation, which is typically at the interface between the electrical connectors.

At least some known electrical connectors include compensation components embedded therein. For example, the electrical connector described by Kenny et al., U.S. Pat. No. 7,540,781 describes one such solution incorporating passive circuit elements soldered directly onto signal conductors of the electrical connector. However, such electrical connectors have reliability problems. For example, the solder joint between the passive circuit element and the signal conductors is subject to damage during the life of the connector, such as from loading, shock, thermal mismatch between the copper signal conductors and the mounting contacts of the passive circuit elements, and the like.

A need remains for an electrical connector that overcomes at least some of the existing problems of signal degradation in a cost effective and reliable manner. A need remains for an electrical connector that overcomes at least some of the existing reliability problems with known solutions.

BRIEF DESCRIPTION OF THE INVENTION

In one embodiment, a connector assembly is provided including a contact module with a lead frame having signal conductors defining separate conductive paths. The contact module also includes a compensation circuit component coupled to the leadframe. The compensation circuit component has a substrate and multiple compensation circuit elements mounted to the substrate, where the substrate is coupled to the leadframe such that the compensation circuit elements are electrically connected to corresponding signal conductors. The contact module also includes a body encasing the signal conductors and the compensation circuit component.

In another embodiment, a connector assembly is provided including a contact module having a lead frame with signal conductors defining separate conductive paths and a compensation circuit component coupled to the leadframe. The compensation circuit component has having a compensation circuit element mounted to a corresponding signal conductor to electrically couple the compensation circuit element and the corresponding signal conductor. The contact module also includes a body overmolded over the leadframe and the compensation circuit component.

In a further embodiment, a connector assembly is provided including a housing having a front, a rear and discrete contact modules loaded into the housing through the rear. Each contact module includes a lead frame having signal conductors defining separate conductive paths and a compensation circuit component coupled to the leadframe. The compensation circuit component has a substrate and a compensation circuit element mounted to the substrate, with the substrate being mounted to a corresponding signal conductor to electrically couple the compensation circuit element and the corresponding signal conductor. The contact module also includes a body overmolded over the leadframe and the compensation circuit component, where the body engages the housing when the contact module is loaded into the housing.

DETAILED DESCRIPTION OF THE INVENTION

Figure 1:
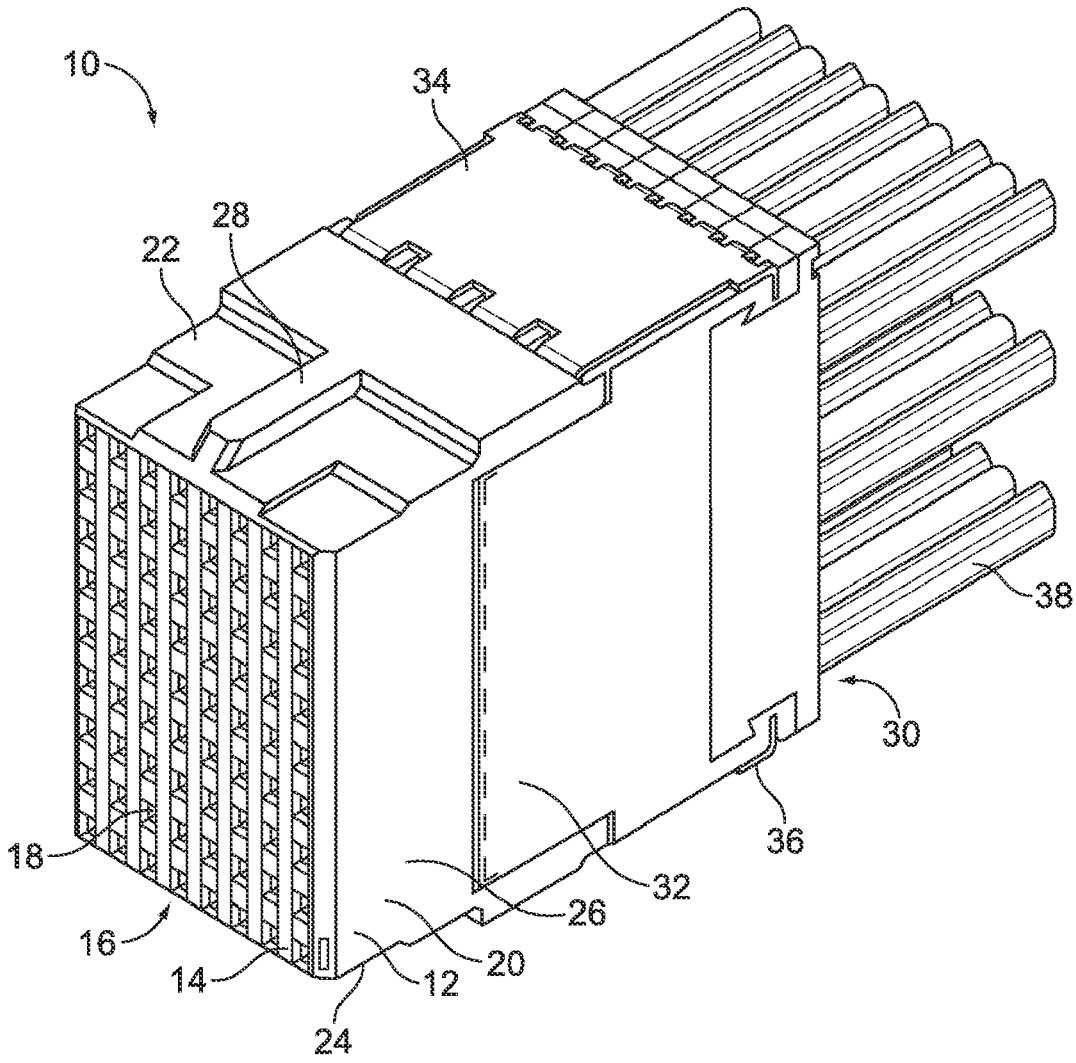
FIG. 1 is a front perspective view of a connector assembly formed in accordance with an exemplary embodiment.

FIG. 1 is a front perspective view of a receptacle connector assembly 10 formed in accordance with an exemplary embodiment. The receptacle connector assembly 10 is matable with a header connector assembly (not shown) to create a differential connector system. For example, the header connector assembly may be a Z-PACK TinMan header connector, which is commercially available from Tyco Electronics. The receptacle connector assembly 10 constitutes a high speed, differential cable connector, however the benefits herein described are also applicable to other connectors in alternative embodiments, such as board mounted connectors, such as the receptacle connector assembly 200 (shown in FIG. 3).

As illustrated in FIG. 1, the receptacle connector assembly 10 includes a dielectric housing 12 having a forward mating end 14 that includes a mating interface 16 and a plurality of contact cavities 18. The contact cavities 18 are configured to receive corresponding mating contacts (not shown) from the header connector assembly. The housing 12 includes a plurality of support walls 20, including an upper shroud wall 22, a lower shroud wall 24 and side walls 26. Alignment ribs 28 are formed on the upper shroud wall 22 and lower shroud wall 24. The alignment ribs 28 cooperate to bring the receptacle connector assembly 10 into alignment with the header connector assembly during the mating process so that the mating contacts of the mating connector are received in the contact cavities 18 without damage.

A plurality of contact modules 30 are received in the housing 12 through a rearward loading end 32 of the housing 12. First and second clips 34, 36 are used to securely couple the contact modules 30 to the housing 12. Cables 38 are terminated to the contact modules 30. The receptacle connector assembly 10 thus defines a cable connector.

Figure 2:
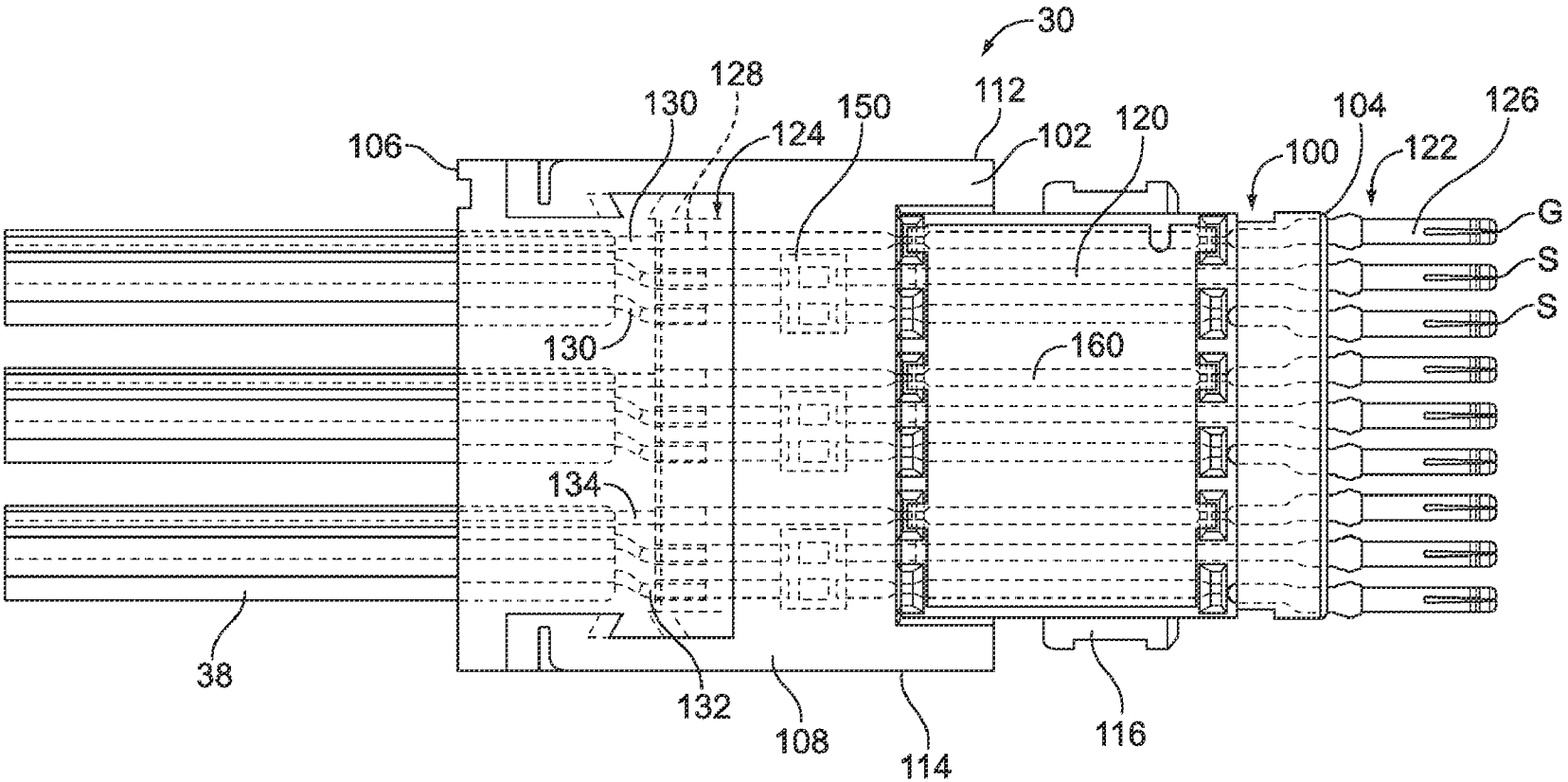
FIG. 2 is a side view of an exemplary contact module for the cable connector assembly shown in FIG. 1.

FIG. 2 is a side view of an exemplary contact module 30 that is matable with the housing 12 (shown in FIG. 1) illustrating an internal structure, including an internal lead frame 100, of the contact module 30 in phantom. The contact module 30 includes a dielectric body 102 that surrounds the lead frame 100. In some embodiments, the dielectric body 102 is manufactured using an overmolding process. During the overmolding process, the lead frame 100 is encased in a dielectric material, such as a plastic material, which forms the dielectric body 102. Optionally, the contact module 30 may be manufactured in stages that include more than one overmolding processes (e.g. an initial overmolding and a final overmolding).

The dielectric body 102 extends between a forward mating end 104 and a rear end 106. The cables 38 extend rearward from the rear end 106. The dielectric body 102 includes a first, generally planar, side surface 108, and a similar second side surface (not shown) opposite the first side surface 108. The first side surface 108 extends substantially parallel to and along the lead frame 100. The dielectric body 102 includes opposed top and bottom ends 112, 114. Optionally, ribs 116 may be provided on each of the top and bottom ends 112, 114. The ribs 116 may be used to guide and/or orient the contact modules 30 into the housing 12.

The lead frame 100 includes a plurality of signal conductors 120 that extend between mating ends 122 and mounting ends 124. Mating contacts 126 are provided at the mating ends 122. The mating contacts 126 are loaded into the contact cavities 18 (shown in FIG. 1) of the housing 12 for mating with corresponding mating contacts of the header connector assembly (not shown). The signal conductors 120 define wire mating portions proximate to the mounting ends 124. For example, the signal conductors 120 may include solder pads 128 at the mounting ends 124 for terminating to respective wires 130 of the cable 38 by soldering or welding. Other terminating processes and/or features may be provided at the mounting ends 124 for terminating the wires 130 to the signal conductors 120. For example, insulation displacement contacts, wire crimp contacts, and the like may be provided at the mounting ends 124. The mating contacts 126 and/or the solder pads 128 may be formed integrally with the signal conductors 120, such as by a stamping and/or forming process. Alternatively, the mating contacts 126 and/or the solder pads 128 may be separately provided and electrically connected to the signal conductors 120.

The mounting ends 124, including the solder pads 128 and ends of the wires 130, are encased within the dielectric body 102. The dielectric body 102 is overmolded over the mounting ends 124 and the solder pads 128. In an exemplary embodiment, the dielectric body 102 is overmolded over the wires 130 after the wires 130 are soldered to the solder pads 128. Optionally, such overmolding of the wires 130 and the solder pads 128 may be accomplished during a secondary overmolding process.

In an alternative embodiment, the mounting ends 124 of the signal conductors 120 may include mounting pins extending from the dielectric body 102 for mounting to a circuit board, rather than for terminating to the wires 130. In such an embodiment, the contact module defines a board mounted contact module rather than a cable mounted contact module. The mounting ends may extend from the rear end 106. Alternatively, the mounting ends may extend from another end, such as the bottom end 114.

In an exemplary embodiment, one or more compensation circuit components 150 are incorporated into the contact module 30 and electrically connected to corresponding signal conductors 120. The compensation circuit components 150 affect the electrical characteristics of the signals being transmitted by the signal conductors 120. The compensation circuit components 150 may include passive electrical devices that are used to control the electrical characteristics of the signals being transmitted by the signal conductors 120, and may thus be referred to as passive circuit components. In an exemplary embodiment, the compensation circuit components 150 include attenuators that are used to lower voltage, dissipate power, and/or to improve impedance matching. The attenuator may include any type of circuit used in RF and AF attenuators, such as PI pads ($\pi$-type) or T pads. The compensation circuit components 150 may be other types of integrated circuits in alternative embodiments that affect the electrical characteristics in other ways. The compensation circuit components 150 may include one or more capacitors, inductors, resistors, or other passive electrical devices. Active electrical devices may be used in alternative embodiments, and may thus be referred to hereinafter as active circuit components. Any number of compensation circuit components 150 may be used with the contact module 30. In an exemplary embodiment, each compensation circuit component 150 is connected to more than one signal conductor 120. Optionally, a single compensation circuit component may be provided that connects to all of the signal conductors 120.

During manufacture or assembly of the contact module 30, the dielectric body 102 may be overmolded over the lead frame 100 and the compensation circuit components 150. For example, the compensation circuit components 150 may be connected to the lead frame 100 prior to the overmolding process, and then the compensation circuit components 150 and the lead frame 100 are overmolded together during the same overmolding step. The dielectric body 102 is overmolded around the compensation circuit components 150 to securely retain the compensation circuit components 150 within the contact module 30.

At least some portions of the dielectric body 102 may be overmolded in a second overmolding step, such as the portion of the dielectric body 102 surrounding the mounting ends 124 and the wires 130. For example, portions of the signal conductors 120 may remain exposed after the initial overmolding step, such as the solder pads 128. The mating contacts 126 are exposed forward of the dielectric body 102. In an exemplary embodiment, side surfaces of the signal conductors 120 are exposed along one or more segments of the signal conductors 120, such as at pinch points that are used during the overmolding process to hold the individual signal conductors 120 of the lead frame 100 in place. After the first overmolding process, the wires 130 of the cable 38 may be terminated to the solder pads 128. After the wires 130 are terminated to the solder pads 128, the dielectric body 102 is overmolded a second time. The dielectric body 102 is overmolded around the cables 38 and wires 130 to securely retain the cables 38 and wires 130 within the contact module 30 and/or to provide strain relief to resist pulling of the wires 130 away from the solder pads 128. Excessive strain, such as pulling on the cables 38, may cause the rear portion of the dielectric body 102 to separate from, or pull away from, the front portion of the dielectric body 102, which may also break the electrical connection between the wires 130 and the signal conductors 120 or between the compensation circuit components 150 and the signal conductors 120. In an exemplary embodiment, the clips 34, 36 (shown in FIG. 1) are used to add stability to the dielectric body 102 to resist separation of the dielectric body 102.

In an exemplary embodiment, the signal conductors 120 are arranged generally parallel to one another between the mating ends 122 and mounting ends 124, and the mating ends 122 and the mounting ends 124 are provided at generally opposite ends of the contact module 30. However, other configurations of signal conductors 120 may be provided in alternative embodiments, such that the signal conductors 120 and/or at least one of the mating and/or mounting ends 122, 124 have different arrangements or positions.

In the illustrated embodiment, the signal conductors 120 are arranged in pairs of signal conductors 120 carrying differential signals with a ground contact 160 associated with each pair of signal conductors 120. The wires 130 include a corresponding set of two signal wires 132 and one ground wire 134. The signal conductors 120 are adapted for connection with the signal wires 132 and the ground contact 160 is adapted for connection to the ground wire 134. Power contacts may also be provided in alternative embodiments.

Figure 3:
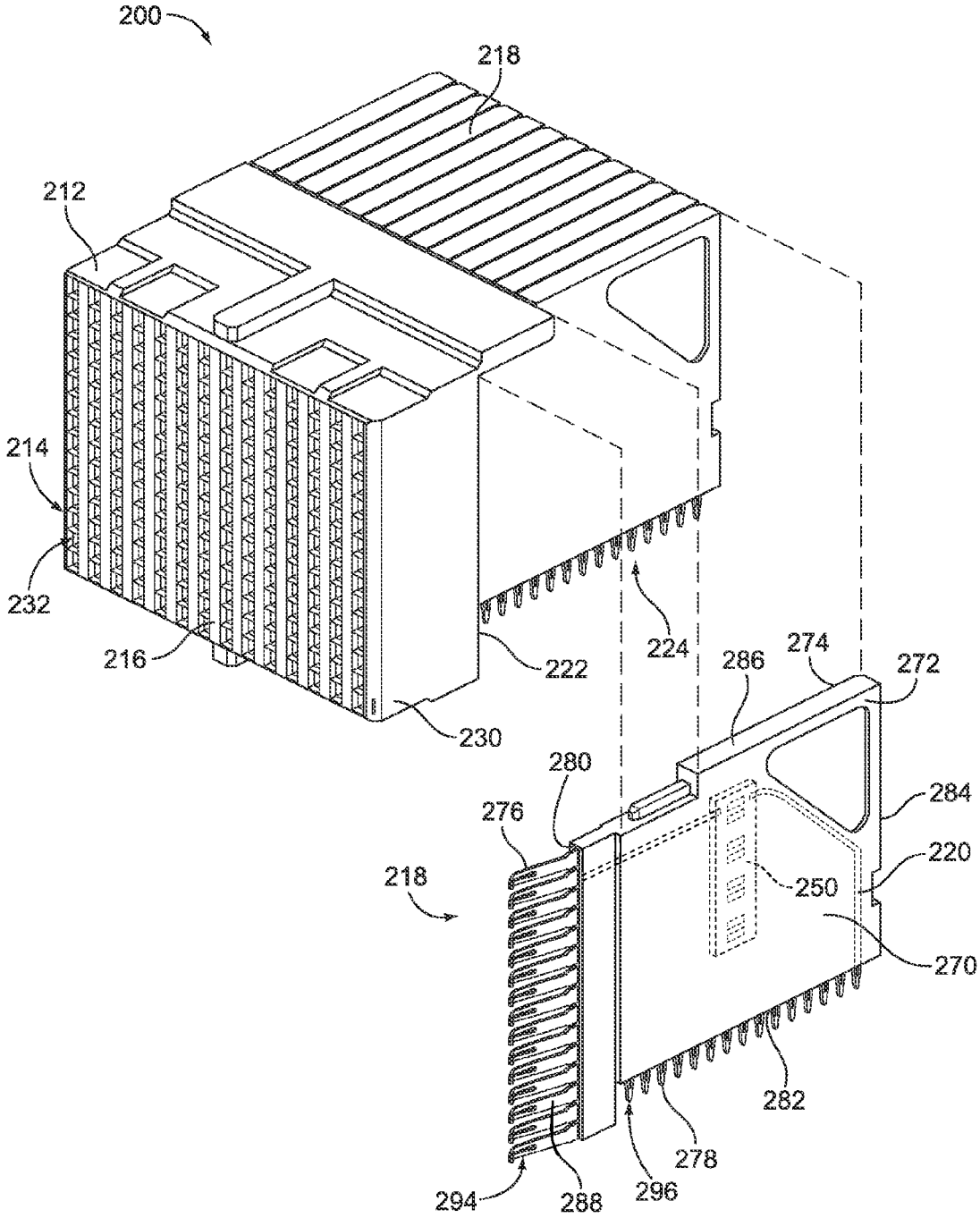
FIG. 3 is a front perspective view of an alternative connector assembly formed in accordance with an alternative embodiment.

FIG. 3 is a front perspective view of an alternative connector assembly 200 formed in accordance with an alternative embodiment. The connector assembly 200 is matable with a header connector assembly (not shown) to create a differential connector system. The connector assembly 200 thus defines a receptacle connector assembly. The connector assembly 200 may include a similar mating face as the connector assembly 10 (shown in FIG. 1). The connector assembly 200 constitutes a high speed, differential board mounted connector configured to be mounted to a circuit board (not shown).

The connector assembly 200 includes a housing 212 having a mating face 214 at a front 216 of the housing 212. The mating face 214 is planar and defines the front or forward-most portion of the connector assembly 200. A plurality of contact modules 218 are held by the housing 212, one of which is shown unmated from the housing 212. The contact modules 218 include signal conductors 220. Both the contact modules 218 and the signal conductors 220 are loaded through a rear 222 of the housing 212. The contact modules 218 define a mounting face 224 of the connector assembly 200. The mounting face 224 is configured to be mounted to a surface of the circuit board. The mating face 214 is oriented perpendicular with respect to the mounting face 224, however non-perpendicular configurations are possible in alternative embodiments.

The housing 212 may be similar to the housing 12 (shown in FIG. 1). The housing 212 includes a body 230 extending between the front 216 and the rear 222. The contact modules 218 are coupled to the rear 222 of the housing 212. A plurality of contact channels 232 extend through the body 230. The contact channels 232 receive portions of the signal conductors 220. The contact channels 232 are arranged in a pattern that complements the pattern of signal conductors 220.

In an exemplary embodiment, one or more compensation circuit components 250 (shown in phantom) are incorporated into the contact modules 218 and electrically connected to corresponding signal conductors 220. The compensation circuit components 250 affect the electrical characteristics of the signals being transmitted by the signal conductors 220. The compensation circuit components 250 include passive electrical devices that are used to control the electrical characteristics of the signals being transmitted by the signal conductors 220.

The contact module 218 includes a contact module body 270 having opposite sides 272, 274. The contact module body 270 holds the signal conductors 220. The signal conductors 220 include mating portions 276 that extend from the contact module body 270 and contact tails 278 that extend from the contact module body 270. Intermediate portions of the signal conductors 220 between the mating portions 276 and the contact tails 278 are encased by the contact module body 270. The compensation circuit components 250 are coupled to the intermediate portions of the signal conductors 220. Optionally, the contact module body 270 may be overmolded over the signal conductors 220 and the compensation circuit components 250. Once overmolded, the mating portions 276 and the contact tails 278 extend from the contact module body 270. Optionally, the signal conductors 220 may be formed from a lead frame 252 (shown in FIG. 4) and the contact module body 270 may be overmolded around the lead frame 252. Alternatively, individual signal contacts, such as stamped and formed contacts, may be separately positioned within the contact module body 270.

The contact module body 270 includes a forward mating edge 280 and a bottom mounting edge 282 that is perpendicular to the mating edge 280. The contact module body 270 also includes a rear edge 284 opposite the mating edge 280 and a top edge 286 opposite the mounting edge 282.

The signal conductors 220 extend between the mating edge 280 and the mounting edge 282 along a conductor plane. The conductor plane is generally parallel to, and oriented between, the sides 272, 274 of the contact module body 270. The mating portions 276 extend forward from the mating edge 280. The contact tails 278 extend downward from the mounting edge 282. The signal conductors 220 may be arranged in pairs with two signal conductors 220 representing a differential pair, and each pair being separated by one or more ground conductors 288 (shown in FIGS. 4-6).

The contact tails 278 may be eye-of-the-needle type contacts that fit into vias in the circuit board. Other types of contacts may be used for through hole mounting or surface mounting to the circuit board in alternative embodiments. In other alternative embodiments, different types of contacts may be used to terminate the contact module 218 to cables rather than to a circuit board.

In the illustrated embodiment, ground conductors 288 are provided between pairs of the signal conductors 220. The ground conductors 288 are part of the lead frame 252 and are held within the contact module body 270 in a similar manner as the signal conductors 220. In an exemplary embodiment, a separate ground shield 290 (shown in FIG. 6) is coupled to the side 274 of the contact module body 270, where the ground shield 290 has fingers 292 (shown in FIG. 6) extending through the contact module body 270 to engage the ground conductors 288. The ground conductors 288 include mating portions 294 and mounting portions 296 at the mating edge 280 and the mounting edge 282, respectively. The ground shield 290 defines a ground plane parallel to the conductor plane defined by the signal conductors 220. In alternative embodiments, rather than ground conductors 288 forming part of the lead frame 252, the ground shield 290 may include ground contacts, similar to the mating and mounting portions 294, 296, that are interspersed between the mating portions 276 and contact tails 278, respectively. In other alternative embodiments, power contacts may also be provided.

During manufacture or assembly of the contact modules 218, the contact module body 270 may be overmolded over the lead frame 252 and the compensation circuit components 250. For example, the compensation circuit components 250 may be connected to the lead frame 252 prior to the overmolding process, and then the contact module body 270 may be overmolded over the compensation circuit components 250 and the lead frame 252 during the same overmolding step.

Figure 5:
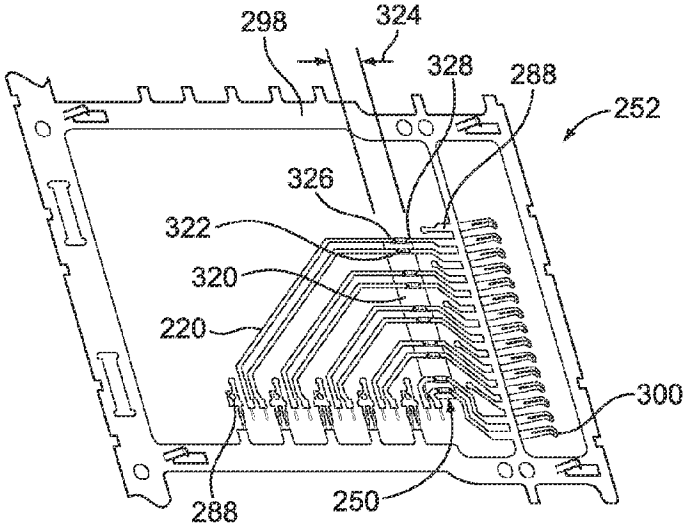
FIGS. 4-6 illustrate different stages of manufacture of a contact module for the connector assembly shown in FIG. 3.
Figure 4:
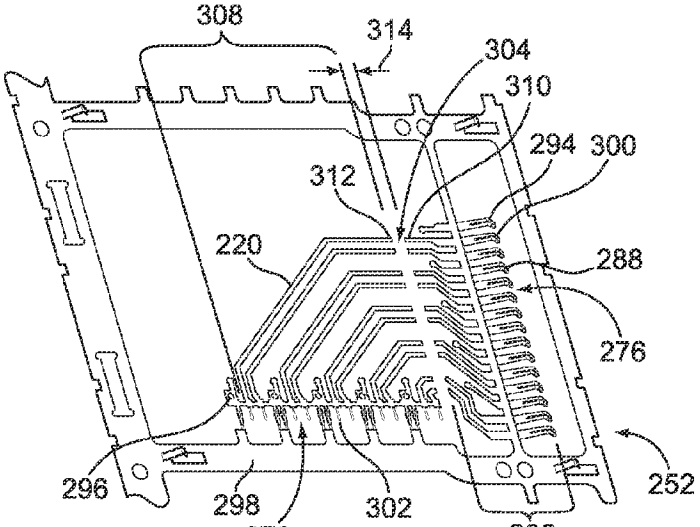
Figure 6:
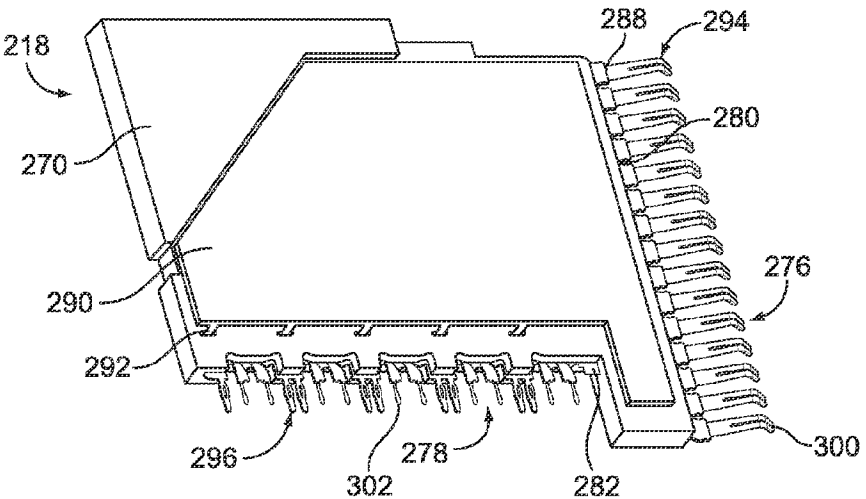

FIGS. 4-6 illustrate different stages of manufacture of the contact module 218. The contact module 30 (shown in FIGS. 1 and 2) may be manufactured in a similar manner. The contact module 218 is manufactured by overmolding the lead frame 252 and the compensation circuit component 250 to form the contact module body 270. FIG. 4 illustrates the lead frame 252 held by a carrier 298, FIG. 5 illustrates the compensation circuit components 250 mounted to the lead frame 252, and FIG. 6 illustrates the contact module body 270 overmolded over the compensation circuit components 250 and the lead frame 252 with the carrier 298 removed.

As shown in FIG. 4, the lead frame 252 includes the plurality of signal conductors 220, which extend between mating ends 300 and mounting ends 302. The mating portions 276 are provided at the mating ends 300. The contact tails 278 are provided at the mounting ends 302. Intermediate portions of the signal conductors 220 extend between the mating portions 276 and the contact tails 278. The intermediate portions of the signal conductors 220 are the portions of the signal conductors 220 that are overmolded by the contact module body 270.

The ground conductors 288 form part of the lead frame 252 and are provided between each of the pairs of signal conductors 220. The mating portions 294 are provided between the mating ends 300 of the signal conductors 220. The mounting portions 296 are provided between the mounting ends 302 of the signal conductors 220. The mating and mounting portions 294, 296 are not connected, but rather are separate from one another. The ground shield 290 (shown in FIG. 6) interconnects the mating and mounting portions 294, 296 to electrically common the mating and mounting portions 294, 296. For example, the fingers 292 engage the mating and mounting portions 294, 296. In an alternative embodiment, the ground conductors 288 may extend between the mating and mounting portions 296, 298.

The lead frame 252 may be manufactured by stamping and forming the individual signal conductors 220 and ground conductors 288 from a blank of sheet metal. The signal conductors 220 and ground conductors 288 are held by the carrier 298 which is simultaneously blanked with, and later removed from, the signal conductors 220 and ground conductors 288. The carrier 298 helps hold the relative positions of the signal conductors 220 and the ground conductors 288, such as during the mounting step of the compensation circuit components 250 and during the overmolding step of the contact module body 270. In an exemplary embodiment, during the stamping process, portions of the signal conductors 220 may be removed to create discontinuities along the conductive paths of the signal conductors 220. As such, the conductive paths are non-continuous between the mating ends 300 and the mounting ends 302. Any number of the signal conductors 220 may have portions removed to create discontinuities along the conductive paths of the signal conductors 220. In an alternative embodiment, rather than stamping, the portions may be removed by other means or processes, such as cutting or drilling, or the signal conductors 220 may be formed from discrete segments arranged proximate one another, such as into the configuration shown in FIG. 4.

Gaps 304 are created between the remaining portions of the signal conductors 220. The gaps 304 create a physical separation between different portions of the signal conductors 220. A mating segment 306 is defined on one side of the gap 304 between the gap 304 and the mating end 300. A terminating segment 308 is defined on the other side of the gap 304 between the gap 304 and the mounting end 302. The mating segment 306 and the terminating segment 308 have contact pads 310, 312, respectively, adjacent the gap 304. The contact pads 310, 312 may have an enlarged cross-sectional area compared to other portions of the signal conductors 202 to provide a mounting area. The gap has a width 314 between the contact pads 310, 312.

In the illustrated embodiment, each of the pairs of signal conductors 220 includes a removed portion. The removed portions of at least some of the pairs are aligned with one another such that the gaps 304 are aligned. Alternatively, only one of the signal conductors 220 may have a removed portion. In some alternative embodiments, less than all of the pairs of signal conductors 220 include removed portions.

As shown in FIG. 5, the compensation circuit components 250 include a substrate 320 and a plurality of compensation circuit elements 322 mounted thereto. In an exemplary embodiment, the substrate 320 is a flexible printed circuit having a thin film defining the substrate with a plurality of traces deposited on or in the film. In another exemplary embodiment, the substrate 320 is a thin circuit board, made from FR-4 or another rigid circuit board material. The circuit board includes a plurality of traces on a surface thereof defining pads for mating engagement with the compensation circuit elements 322 and the contact pads 310, 312.

The substrate 320 has a width 324 that is wider than the width 314 of the gap 304. As such, the substrate 320 is able to span entirely across the gap 304. The substrate 320 includes signal conductor contacts 326, 328 for mating engagement with the contact pads 310, 312 of the signal conductors 220. The signal conductor contacts 326, 328 may be coupled to the contact pads 310, 312 using a conductive epoxy, solder, and the like.

In an exemplary embodiment, the compensation circuit elements 322 are mounted to the substrate 320 between corresponding signal conductor contacts 326, 328. The compensation circuit elements 322 are flanked on either side by the signal conductor contacts 326, 328. As such, when the substrate 320 is mounted to the lead frame 252, the compensation circuit elements 322 are located within the gaps 304. In the illustrated embodiment, the compensation circuit elements 322 do not make direct connection with the signal conductors 220. Rather, the compensation circuit elements 322 make electrical connection to the signal conductors 220 through the substrate 320. In an alternative embodiment, the compensation circuit elements 322 may be directly connected to the signal conductors 220. For example, the compensation circuit component 250 may not include a substrate, but rather just the compensation circuit elements 322 or an array of compensation circuit elements 322 that are coupled directly to the signal conductors 220. Optionally, the compensation circuit elements 322 may be connected to individual signal conductors 220, such as in a one-to-one relationship. Alternatively, compensation circuit elements 322 may be connected to multiple signal conductors 220, which may provide rigidity to the interface with the signal conductors. When the compensation circuit elements 322 are overmolded with the signal conductors 220 in the same molding process, a robust connection is made that may be less susceptible to stresses and cracking than if molded in separate molding processes or if the compensation circuit elements 322 were not overmolded at all.

The substrate 320 may be used to simultaneously electrically connect multiple compensation circuit elements 322 to corresponding signal conductors 220. The substrate 320 provides a thermal barrier between the compensation circuit elements 322 and the signal conductors 220, which reduces thermal mismatch therebetween. The substrate 320 also reduces stress at the connection of the signal conductor contacts 326, 328 and the contact pads 310, 312 because the substrate 320 has a greater surface area that is engaged by the contact module body 270. As such, a reliable connection is created between the compensation circuit component 250 and the signal conductors 220.

As shown in FIG. 6, after the compensation circuit components 250 are coupled to the signal conductors 220, the contact module body 270 is overmolded. Both the compensation circuit components 250 and the signal conductors 220 are co-molded. In an exemplary embodiment, the compensation circuit components 250 are entirely overmolded such that the compensation circuit components 250 are completely encased in the contact module body 270. Once overmolded, the mating portions 276 and the contact tails 278 are the only portions of the signal conductors 220 that are not overmolded, but rather extend from the mating edge 280 and the mounting edge 282, respectively.

Figure 7:
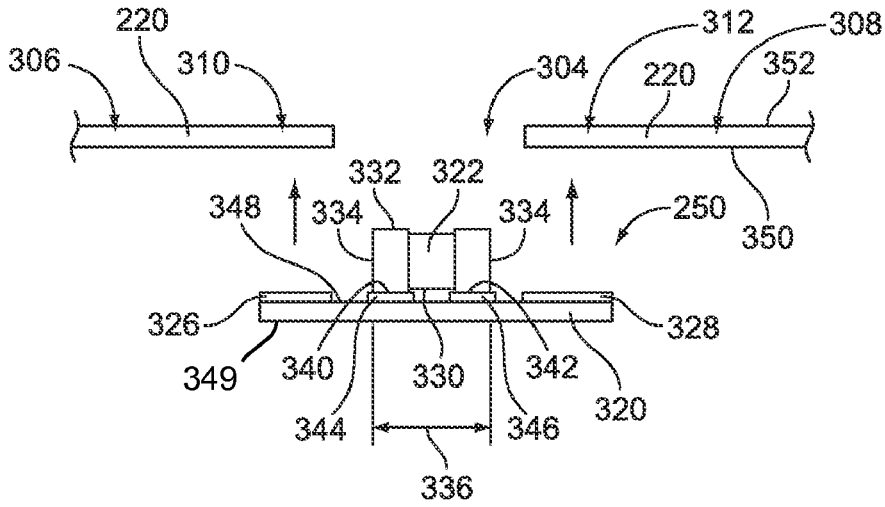
FIGS. 7 and 8 illustrate a compensation circuit component for the contact module shown in FIGS. 4-6.
Figure 8:
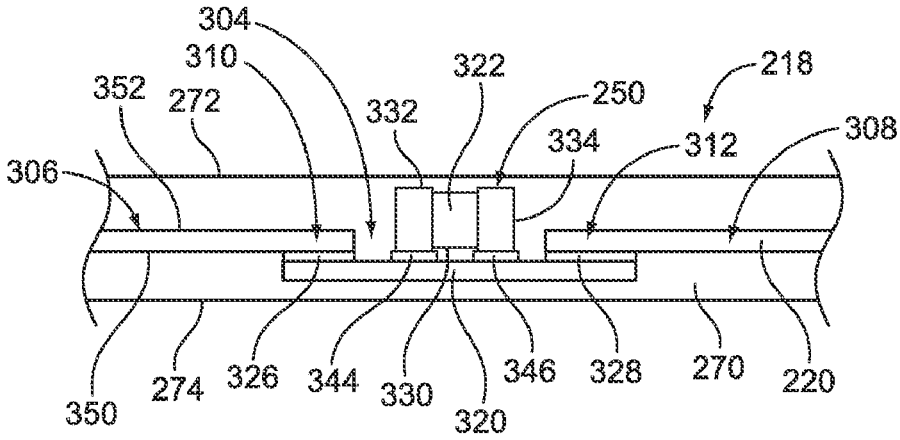

FIGS. 7 and 8 illustrate the compensation circuit component 250 for the contact module 218, a portion of which is shown in FIG. 8. The compensation circuit component 250 includes the substrate 320 and the compensation circuit element 322, any number of which may be mounted to the substrate 320. The compensation circuit element 322 controls the electrical characteristics of the signals being transmitted by the signal conductors 220. In an exemplary embodiment, the compensation circuit element 322 may be an attenuator that is used to lower voltage, dissipate power, and/or to improve impedance matching. The compensation circuit element 322 may be a capacitor, inductor, resistor, or other passive electrical device.

The compensation circuit element 322 has an inner end 330, an outer end 332 and sides 334 extending therebetween. The compensation circuit element 322 has a width 336 between the sides 334. The inner end 330 is mounted to the substrate 320 and the outer end 332 is opposite the inner end 330. The compensation circuit element 322 includes a first contact 340 and a second contact 342 exposed at the inner end 330 for mounting to the substrate 320. The first and second contacts 340, 342 are mounted to corresponding element contacts 344, 346, respectively, on the substrate 320. The first element contact 344 is electrically connected to the first signal conductor contact 326 and the second element contact 346 is electrically connected to the second signal conductor contact 328. Both the element contacts 344, 346 and the signal conductor contacts 326, 328 are arranged on a first surface 348 of the substrate 320. The substrate has a second surface 349 opposite the first surface 348.

The signal conductors 220 have a first side 350 and an opposite second side 352. The sides 350, 352 are generally planar and define the conductor plane, which is generally parallel to, and oriented between, the sides 272, 274 of the contact module body 270, as shown in FIG. 8. The sides 272 define an outer perimeter of the contact module body 270. The lead frame 252 and the compensation circuit component 250 are entirely within the outer perimeter of the contact module body 270. In an exemplary embodiment, the compensation circuit component 250 is mounted to the first side 350 of the signal conductors 220. As such, the compensation circuit element 322 is loaded into the gap 304. The compensation circuit element 322 does not engage the signal conductors 220. The substrate 320 spans across the gap 304, and the signal conductor contacts 326, 328 are terminated to the contact pads 310, 312. The compensation circuit component 250 bridges the gap 304 to connect the conductive paths of the signal conductors 220. Signals transmitted along the signal conductors 220 are transmitted through the compensation circuit component 250. The substrate 320 is mechanically and electrically coupled to the contact pads 310, 312. The substrate 320 interconnects the mating segments 306 and the terminating segments 308 of the corresponding signal conductors 220. In an exemplary embodiment, the signal conductor contacts 326, 328 may be relatively long to ensure adequate mating to the contact pads 310, 312. In an exemplary embodiment, the signal conductor contacts 326, 328 are longer than the element contacts 344, 346. Optionally, the signal conductor contacts 326, 328 may be more than twice as long as the element contacts 344, 346.

During assembly, when oriented as shown in FIG. 8, the compensation circuit component 250 is mounted underneath the signal conductors 220 to the first side 350, with the compensation circuit element 322 loaded into the gap 304 from beneath the signal conductors 220. Once assembled, the outer end 332 of the compensation circuit element 322 is positioned above of the second side 352, but the inner end 330 is positioned below the second side 352. Optionally, the inner end 330 may be approximately coplanar with the first side 350. Alternatively, the inner end 330 may be below the first side 350. Such mounting arrangement of the compensation circuit component 250 allows for a reduced overall height of the contact module 218, which allows for a connector assembly 200 (shown in FIG. 3) that is more dense, because more contact modules 218 may be stacked together within the housing 212. In an alternative embodiment, rather than mounting to the first side 350, the compensation circuit component 250 may be mounted to the second side 352. For example, either the first surface 348 or the second surface 349 may be mounted to the second side 352. While the stack up height may be higher in such configurations, the gap 304 may be narrower, and may even be narrower than the width of the compensation circuit element 322.

As shown in FIG. 8, when the contact module body 270 is overmolded, the compensation circuit component 250 is entirely encased in the contact module body 270. A portion of the contact module body 270 is provided outward of the outer end 332, such that the outer end 332 is covered by the contact module body 270. Additionally, the sides 334 are encased by the contact module body 270 and held in place by the overmolded contact module body 270.

Figure 9:
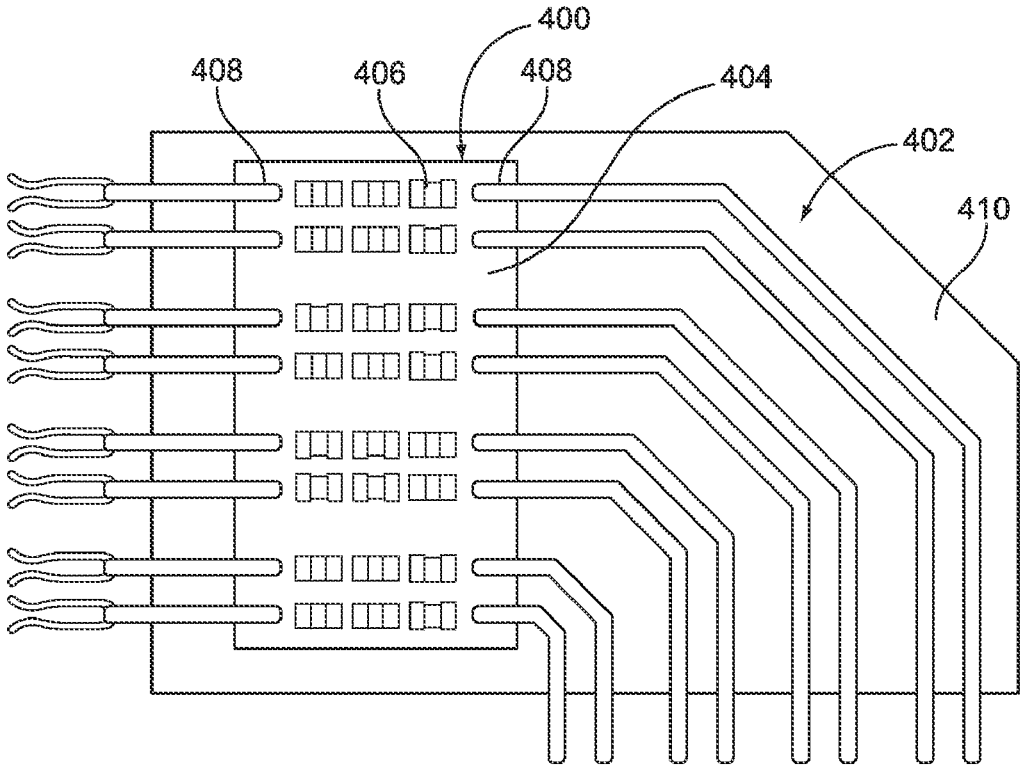
FIG. 9 illustrates an alternative compensation circuit component.

FIG. 9 illustrates an alternative compensation circuit component 400 connected to a lead frame 402. The compensation circuit component 400 includes a substrate 404 having a plurality of compensation circuit elements 406. The compensation circuit component 400 is terminated to signal conductors 408. Multiple compensation circuit elements 406 are provided in the signal path of the signal conductors 408. The substrate 404 may be terminated to the signal conductors 408 in a similar manner as described above. The signal conductors 408 and the compensation circuit component 400 may be overmolded together in a similar manner as described above to form a contact module body 410.

Figure 10:
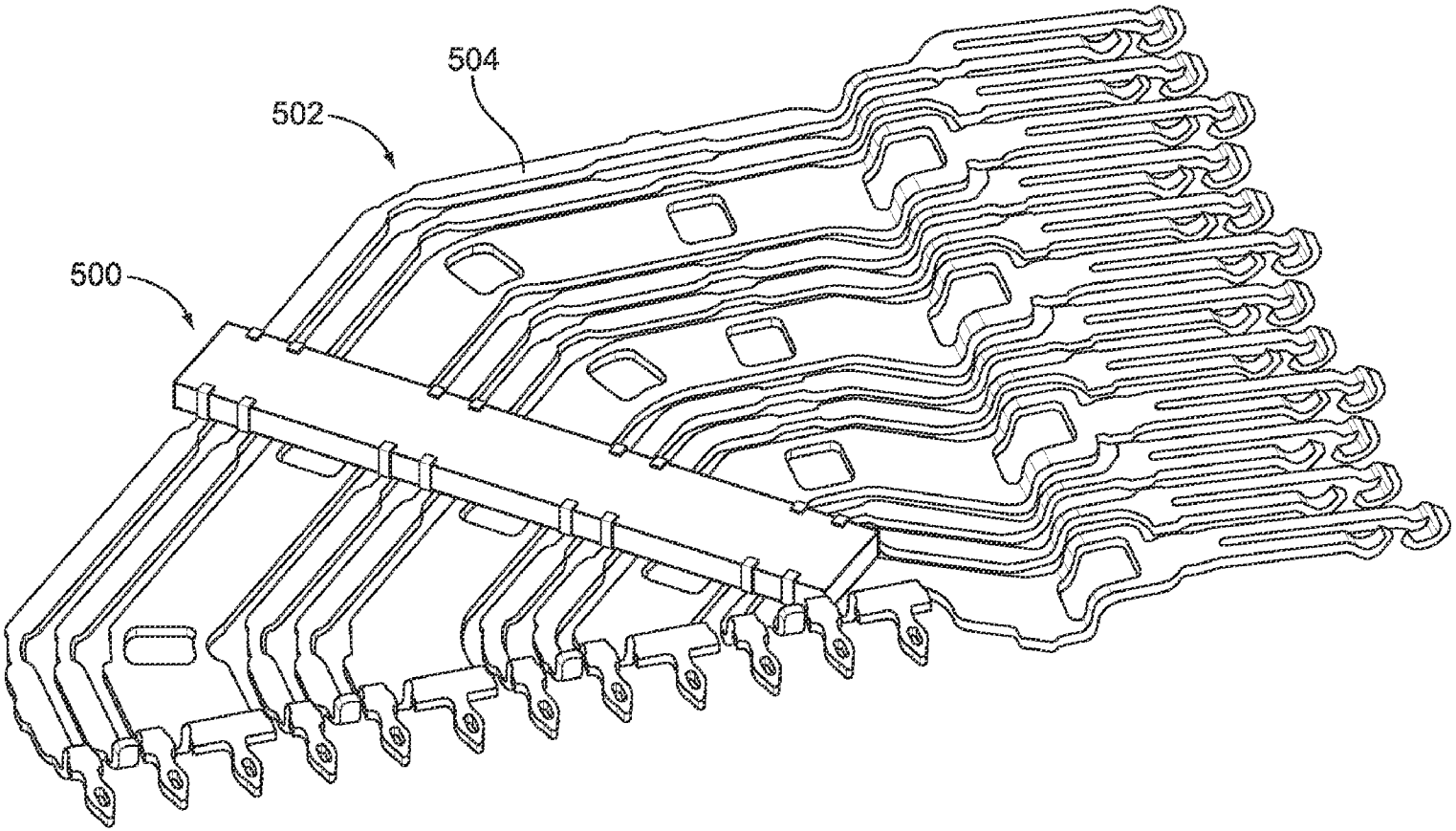
FIG. 10 is a perspective view of an alternative compensation circuit connected to a leadframe.

FIG. 10 illustrates an alternative compensation circuit component 500 connected to a leadframe 502. The compensation circuit component 500 does not include a substrate, but rather is a single compensation circuit element that is terminated to multiple signal conductors 504 of the leadframe 502. Alternatively, multiple compensation circuit components 500 may be provided, each being terminated to one of the signal conductors 504. The compensation circuit component 500 may be terminated to the signal conductors 504 in a similar manner as described above. The signal conductors 504 and the compensation circuit component 500 may be overmolded together in a similar manner as described above to form a contact module body.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A connector assembly comprising:

a contact module comprising a lead frame having signal conductors defining separate conductive paths;

the contact module comprising a compensation circuit component coupled to the leadframe, the compensation circuit component having a substrate and multiple compensation circuit elements mounted to the substrate, the substrate being coupled to the leadframe such that the compensation circuit elements are electrically connected to corresponding signal conductors; and the contact module comprising a body encasing the signal conductors and the compensation circuit component.

2. The connector assembly of claim 1, wherein the compensation circuit component is completely encased by the body.

3. The connector assembly of claim 1, wherein the signal conductors and the compensation circuit component are co-molded with one another during an overmolding process that forms the body.

4. The connector assembly of claim 1, wherein the signal conductors have gaps along the conductive paths, the compensation circuit elements being received in the gaps such that a portion of the compensation circuit elements are in a common plane with the signal conductors.

5. The connector assembly of claim 1, wherein the signal conductors have gaps along the conductive paths with signal conductor pads on opposite sides of the gaps, the substrate having a first surface and a second surface with the compensation circuit elements mounted to the first surface, the substrate having signal conductor contacts on the first surface terminated to corresponding signal conductor pads.

6. The connector assembly of claim 1, wherein the signal conductors have a first side and a second side defining a signal conductor plane therebetween, the signal conductors having gaps along the conductive paths, the compensation circuit elements having an inner end being mounted to the substrate and an outer end opposite the inner end, the substrate being mounted to the first side of the signal conductors such that the compensation circuit elements extend through the gaps with the outer end of the compensation circuit elements being outward of the second side of the signal conductors.

7. The connector assembly of claim 1, wherein the signal conductors have mating ends and mounting ends, the mounting ends being one of board mounted or cable mounted.

8. The connector assembly of claim 1, wherein the substrate is a flexible printed circuit having element contacts electrically connected to corresponding signal conductor contacts, the compensation circuit elements being mounted to the element contacts, the signal conductor contacts being mounted to corresponding signal conductors.

9. The connector assembly of claim 1, wherein the body includes planar first and second sides defining an outer perimeter of the contact module, the leadframe and the compensation circuit component being entirely within the outer perimeter.

10. The connector assembly of claim 1, wherein the compensation circuit elements are indirectly coupled to corresponding signal conductors via the substrate.

11. The connector assembly of claim 1, wherein the signal conductors define gaps along the conductive paths thereof such that the conductive paths of the signal conductors are interrupted, the compensation circuit component being coupled to at least two adjacent signal conductors such that the substrate spans the gaps to electrically connect the corresponding signal conductors.

12. The connector assembly of claim 1, wherein the signal conductors extend between mating ends and mounting ends, the signal conductors having electrical discontinuities such that the conductive paths are non-continuous between the mating end and the mounting end, the compensation circuit component being coupled to the signal conductors at the discontinuities such that the compensation circuit component forms part of the conductive paths.

13. The connector assembly of claim 1, wherein the compensation circuit elements each include an inner end, an outer end and sides extending between the inner and outer ends, the inner end being terminated to the substrate, the body being overmolded over the compensation circuit element such that the body engages the sides and the outer end.

14. A connector assembly comprising:

a contact module comprising a lead frame having signal conductors defining separate conductive paths;

the contact module comprising a compensation circuit component coupled to the leadframe, the compensation circuit component comprising a compensation circuit element mounted to a corresponding signal conductor to electrically couple the compensation circuit element and the corresponding signal conductor; and the contact module comprising a body overmolded over the leadframe and the compensation circuit component.

15. The connector assembly of claim 14, wherein the compensation circuit element is directly terminated to the corresponding signal conductor prior to overmolding the body.

16. The connector assembly of claim 14, wherein the compensation circuit component includes a substrate, the compensation circuit element being terminated to the substrate, the substrate being terminated to the signal conductors to electrically couple the compensation circuit element and the corresponding signal conductor.

17. A connector assembly comprising:

a housing having a front and a rear; and discrete contact modules loaded into the housing through the rear, the contact modules comprising:

a lead frame having signal conductors defining separate conductive paths;

a compensation circuit component coupled to the leadframe, the compensation circuit component having a substrate and a compensation circuit element mounted to the substrate, the substrate being mounted to a corresponding signal conductor to electrically couple the compensation circuit element and the corresponding signal conductor; and a body overmolded over the leadframe and the compensation circuit component, the body engaging the housing when the contact module is loaded into the housing.

18. The connector assembly of claim 17, wherein the compensation circuit component is completely encased by the body after the overmolding process.

19. The connector assembly of claim 17, wherein the substrate includes element contacts electrically connected to corresponding signal conductor contacts, the compensation circuit element being mounted to the element contacts, the signal conductor contacts being mounted to corresponding signal conductors.

20. The connector assembly of claim 17, wherein the body includes planar first and second sides defining an outer perimeter of the contact module, the leadframe and the compensation circuit component being entirely within the outer perimeter such that the first and second sides are configured to abut the body of an adjacent contact module when loaded into the housing.

* * * * *